United States Patent [19]

Antos

[11] 4,212,727

[45] Jul. 15, 1980

[54] PROCESS FOR THE SIMULTANEOUS PRODUCTION OF A HIGH OCTANE MOTOR FUEL AND ISOBUTANE

[75] Inventor: George J. Antos, Bartlett, Ill.

[73] Assignee: UOP Inc., Des Plaines, Ill.

[21] Appl. No.: 850

[22] Filed: Jan. 2, 1979

[51] Int. Cl.[2] ..... C07C 9/12; C10G 35/06; C10G 13/10; B01J 29/12

[52] U.S. Cl. ..... 208/111; 208/DIG. 2; 208/138; 252/455 Z; 252/477 R; 585/700; 585/722

[58] Field of Search ..... 208/111, 138–139; 260/676 R; 585/700, 722

[56] References Cited

U.S. PATENT DOCUMENTS

| | | | |
|---|---|---|---|
| 4,140,621 | 2/1979 | Franck et al. | 208/58 |
| 4,141,859 | 2/1979 | Plank et al. | 208/139 X |

*Primary Examiner*—Delbert E. Gantz
*Assistant Examiner*—G. E. Schmitkons
*Attorney, Agent, or Firm*—James R. Hoatson, Jr.; John G. Cutts, Jr.; William H. Page, II

[57] ABSTRACT

A process for the simultaneous production of high octane motor fuel and isobutane. The process is effected with a physical mixture of compatible reforming catalyst and hydrocracking catalyst.

3 Claims, No Drawings

PROCESS FOR THE SIMULTANEOUS PRODUCTION OF A HIGH OCTANE MOTOR FUEL AND ISOBUTANE

The present invention is a process for the conversion of hydrocarbons boiling below about 450° F. into high octane motor fuel which does not require the addition of metallic compounds, i.e., lead or phosphorous compounds, to enhance the anti-knock characteristics thereof and butane. Although aromatic hydrocarbons, principally benzene, toluene and the various xylene isomers, are required in large quantities to satisfy the demand for a wide variety of petrochemicals, a principal utilization thereof is as gasoline blending components in the production of a high octane motor fuel. Benzene has a clear research octane blending value of about 99, while the more abundant toluene and other aromatics have a value in excess of about 100; they are, therefore, the predominant octane-improvers in a refinery gasoline pool. One well-known and well-documented refining process, capable of providing significant improvement in the octane rating of naphtha boiling range fractions, is the catalytic reforming process. In such a process, the principal octane-improving reactions are naphthene dehydrogenation, naphthene dehydroisomerization, paraffin dehydrocyclization and paraffin hydrocracking. Naphthene dehydrogenation is an extremely rapid reaction constituting the principal octane improving reaction. With respect to a five-membered ring alkyl naphthene, it is first necessary to effect isomerization to produce a six-membered ring naphthene, followed by the dehydrogenation thereof to an aromatic hydrocarbon. Paraffin aromatization is achieved through the dehydrocyclization of straight-chain paraffins having at least six carbon atoms per molecule. This latter reaction is limited in view of the fact that the aromatic concentration increases as the charge stock transverses the reforming reaction zones, thereby decreasing the rate of additional dehydrocyclization. Unreacted, relatively low octane paraffins, principally comprising pentanes and hexanes, are, therefore present in the reformed product effluent and effectively reduce the overall octane rating thereof.

Investigations into environmental pollution have indicated that more than half the violence perpetrated upon the atmosphere stems from vehicular exhaust consisting primarily of unburned hydrocarbon, carbon monoxide and nitrogen oxides. These investigations have resulted in the development of various catalytic converters which, when installed within the exhaust system, are capable of converting more than 90% of the noxious components. During the development of these catalytic converters, it was learned that the efficiency of conversion and stability of the selected catalytic composites were severely impaired when the exhaust fumes resulted from the combustion of metal-containing motor fuel. Therefore, it has been recognized throughout the petroleum industry, as well as in major gasoline-consuming countries, that suitable motor fuels must ultimately be produced for consumption in current internal combustion engines without requiring the addition of metal-containing, ecologically-deleterious compounds.

It has been observed that a narrow boiling range motor fuel, consisting almost exclusively of $C_5$–$C_8$ hydrocarbons, with only minor quantities of $C_4$ and $C_9$ (and heavier), would have certain advantages in reducing the emmission of unburned hydrocarbons into the atmosphere. Currently-marketed gasolines have a much broader boiling range, particularly with respect to the high-boiling end. One of the principal objects of my invention is to offer an efficient process for producing a highly desirable narrow-boiling range motor fuel. It is also being recognized that unburned hydrocarbons and carbon monoxide are not the only dangerous pollutants being discharged via vehicular exhaust. The possibility that metal compounds emitted in exhaust gases contribute to metal poisoning has resulted in appropriate legislation, enacted in many countries, to reduce significantly or eliminate the quantity of metal compounds permitted in motor fuel.

One natural consequence of the removal of lead, in addition to others, resides in the fact that petroleum refining techniques will necessarily experience modification in order to produce the required voluminous quantities of a high octane, metal-free motor fuel, in an economically attractive fashion.

With respect to a high severity catalytic reforming system, paraffinic hydrocarbons are subjected to, and undergo cracking. Although this partially increases the octane rating of the gasoline boiling range product, substantial quantities of normally gaseous material are produced. At a relatively low reforming severity, paraffin cracking is decreased with the result that an increased quantity of low octane rating saturates is produced. In order to upgrade the overall quality of the gasoline, either the addition of lead becomes necessary, or the low octane rating saturates must be subjected to further processing to produce higher octane components. As previously stated, additional processing of the saturates can be eliminated by increasing the severity of operation within the catalytic reforming reaction zone. This type of operation produces a two-fold effect, notwithstanding an increase in the final octane rating of the ultimate product; first, additional high octane aromatic components are produced and, secondly, the low octane components are at least partially eliminated by conversion either to aromatic hydrocarbons, or to light normally gaseous material. The end result includes a lower liquid yield of motor fuel due both to "shrinkage" in molecular size, and to the production of the aforesaid light gaseous components.

Such problems attendant to the production of a high octane, metal free motor fuel, are eliminated through the utilization of the process of my invention. The application of the present process is by no means limited to the production of metal-free gasoline, but is also advantageous where metal-containing gasolines may be required.

In addition to the production of metal-free high octane gasoline, the process is useful for the production of butane and particularly isobutane as well. Isobutane is used in chemical synthesis, as a refrigerant and as an aerosol propellant. In chemical synthesis, isobutane is converted to isobutenes for use in the production of butyl rubber, the manufacturer of copolymer resins with butadiene and acrylonitrile. Furthermore, isobutane is a valuable component as a feedstock for catalytic alkylation process units used for the production of hydrocarbon alkylate which is a valuable high octane blending component for gasoline.

Hydrocarbonaceous charge stocks, contemplated for conversion in accordance with the present invention, constitute naphtha boiling range hydrocarbon fractions and/or distillates. "Gasoline boiling range hydrocarbons" generally connotes those hydrocarbons, usually devoid of pentane and lighter material, having an initial boiling point of at least about 100° F., and an end boiling point less than about 450° F., and is inclusive of intermediate boiling range fractions often referred to in the art as "light naphtha" and "heavy naphtha". However, it is not intended to limit the present invention to a charge stock having a particular boiling range. Suffice to say, a suitable charge stock will generally have an initial boiling point above about 100° F. and an end boiling point below about 450° F. The precise boiling range of any given naphtha fraction will be dependent upon the economic and processing considerations which are prevalent in the particular locale where such a charge stock is available.

A key feature of the present invention resides in admixture of a high activity reforming catalyst and a compatible hydrocracking catalyst in which alkyl side chains on aromatic hydrocarbons are reduced and cracked to useful components, higher molecular weight paraffins are cracked into more highly branched, lower boiling material and the ring structure of both naphthenes and aromatics is largely preserved to result in exceptional product quality and volumetric yield.

It must be acknowledged that the prior art contains references to the hydrocracking of hydrocarbon fractions followed by the catalytic reforming of a portion of the hydrocracked product effluent. The distinct feature of my invention, however, resides in the utilization of a mixture of a highly active reforming catalyst together with a compatible hydrocracking catalyst in a reaction zone in which the operating conditions of pressure, hydrogen recycle and contaminant level are such that a single reaction zone will yield a high octane motor fuel and isobutane. That is, the process may be performed in a single reaction zone without the necessity of having to provide a reaction zone for the hydrocracking catalyst and another subsequent reaction zone for the reforming catalyst.

By combining both catalysts in a single reaction zone, only a single separation system is required which allows for the elimination of one entire system involving cooling, condensing, high-pressure separation, compression and hydrogen recycle.

A principal object of the present invention is to afford the production of a high octane motor fuel and isobutane. A corollary objective is to produce an aromatic-rich, normally liquid motor fuel product heavily concentrated in high octane rating isoparaffins.

A specific object is to provide an improved process for the production of a narrow boiling range high octane motor fuel and isobutane utilizing an admixture of a high activity reforming catalyst and a compatible selective hydrocracking catalyst.

Therefore, in a broad embodiment, my invention encompasses the simultaneous production of a high octane motor fuel and isobutane which comprises the steps of: (a) contacting a hydrocarbon boiling at a temperature of less than about 450° F. with hydrogen in a reaction zone containing a commingled physical mixture of a high performance reforming catalyst and a compatible hydrocracking catalyst at a temperature in the range of about 700° F. to about 1100° F. and at a pressure of from about 100 to 700 psig; and (b) recovering a high octane motor fuel and isobutane from the reaction zone effluent.

In a more specific embodiment, the present invention is directed toward a process for the simultaneous production of a high octane motor fuel and isobutane which comprises the steps of: (a) contacting a hydrocarbon boiling at a temperature of less than about 450° F. and containing cyclic components including aromatics with hydrogen in a reaction zone, containing a commingled physical mixture of a first catalytic composite comprising a Group VIII noble metal component and a zeolite aluminosilicate carrier material and a second catalytic composite comprising alumina, platinum and a platinum promoter selected from the group of rhenium, tin, germanium, cobalt, nickel, iridium, rhodium and ruthenium or combinations of these elements, at a temperature in the range of about 700° F. to about 1100° F. and at a pressure of from about 100 to about 700 psig.; and (b) recovering a high octane motor fuel and isobutane from the resulting reaction zone effluent.

Other embodiments of my invention involve the composition of the catalytic composites, operating conditions, various processing techniques and the relative quantities of both hydrocracking and reforming catalysts.

As hereinbefore set forth, the present invention constitutes an improved combination process for the production of a high octane motor fuel and isobutane. A key feature of the combination process is processing the charge stock in a reaction zone containing a commingled physical mixture of a first catalytic composite comprising a Group VIII noble metal component and a zeolitic aluminosilicate carrier material and a second catalytic component comprising alumina, platinum and a platinum promotor selected from the group of rhenium, tin, germanium, cobalt, nickel, iridium, rhodium and ruthenium or combinations of these elements. The charge stock may be obtained from a multitude of sources. For example, one suitable source constitutes the naphtha distillate derived from a full boiling range petroleum crude oil; another source is the naphtha fraction obtained from the catalytic cracking of gas oil, while still another source constitutes the gasoline boiling range effluent from a hydrocracking reaction zone which processes heavier-than-gasoline charge stocks. In view of the fact that the greater proportion of such naphtha fractions are contaminated through the inclusion of sulfurous and nitrogenous compounds, as well as olefinic hydrocarbons, it is contemplated that such contaminants will be removed by conventional hydrorefining before the charge stock is supplied to the process of the present invention. Details of hydrorefining processes are well known and thoroughly described in the prior art. It is understood that such pretreatment of the charge stock is not a novel feature of the present process.

Catalytic composites utilized as the reforming catalysts of the present invention include a refractory inorganic oxide carrier material containing a catalytically active metallic component which is generally selected from the noble metals of Group VIII. Recent developments in the area of catalytic reforming have indicated that catalyst activity and stability are significantly enhanced through the addition of various modifiers or attenuators such as tin, rhenium, cobalt, nickel, germanium, iridium, rhodium and/or ruthenium or combinations of these promoters.

Suitable porous carrier materials include refractory inorganic oxides such as alumina, silica, zirconia, and zeolites such as faujasite, mordenite, and combinations of refractory inorganic oxides with the various zeolites. Generally favored metallic components include ruthenium, rhodium, palladium, osmium, iridium, platinum, rhenium, germanium, nickel, tin and cobalt, as well as mixtures thereof.

These metallic components are employed in concentrations ranging from about 0.01 percent to about 5 percent by weight, and preferably from about 0.01 percent to about 2 percent by weight. Since one of the functions of the reforming catalyst is the dehydrocyclization of paraffins to form aromatics, the catalyst may also contain combined halogen selected from the group of fluorine, chlorine, bromine, iodine and mixtures thereof.

Effective operating conditions include catalyst temperatures within the range of about 700° F. to about 1100° F. The liquid hourly space velocity, defined as volumes of hydrocarbon charge per hour of catalyst within the reaction zone, is generally in the range of about 1 to about 20. The hydrogen circulation in admixture with the hydrocarbon feed stock is generally from about 1 to about 20 mols of hydrogen per mol of hydrocarbon. Pressures in the range of about 75 to about 1000 psig are suitable for effecting reactions of the present invention.

The essential carrier material for the hydrocracking catalyst comprises a zeolite. A suitable zeolite is mordenite and a suitable carrier material is mordenite containing alumina fixed in combination therewith. Mordenite is a particular zeolite, highly siliceous in nature and generally characterized by a silica/alumina mol ratio of from about 6 to about 12 as manufactured or found in its material state.

The mordenite crystal structure comprises four and five membered rings of silica and alumina tetrahedra so arranged that the resulting crystal lattice comprises pores and channels running parallel along the crystal axis to give a tubular configuration. This structure is unique among the zeolites since the channels and tubes do not intersect and access to the cages or cavities is in only one direction. For this reason, the mordenite structure is frequently referred to as two-dimensional. This is in contrast to other well known zeolites, for example faujasite and zeolite A, in which the cages can be entered from three directions.

The zeolite having a mordenite crystal structure and containing alumina fixed in combination therewith is prepared by heating an amorphous silica-alumina composite in admixture with an aqueous alkali metal solution and forming a zeolite with a mordenite crystal structure. The resulting mordenite is then heated in an alumina sol, thereafter separating excess sol, treating the zeolite-sol product at conditions effecting gelation of the sol, aging the resulting composition in an alkaline media and thereafter, washing, drying and calcining.

For purposes of the present invention, the catalyst may be formed in any desired shape such as spheres, pellets, pills, cakes, extrudates, powders, granules, etc. However, a particularly preferred form of the catalyst is the sphere; and spheres may be continuously manufactured by the well-known oil drop method which comprises forming an alumina hydrosol, preferably by reacting aluminum metal with hydrochloric acid, combining the hydrosol with a suitable gelling agent such as hexamethylenetetramine to form a dropping solution, uniformly distributing finely divided mordenite particles throughout the dropping solution, and dropping the resultant mixture into an oil bath maintained at elevated temperatures. Alternatively, the particles may be commingled with the sol to form a mixture thereof and the gelling agent thereafter added to the mixture to form the dropping solution. In either case, the droplets of the mixture remain in the oil bath until they set and form substantially spherical hydrogel particles. The spheres are then continuously subjected to specific aging treatments in oil and an ammoniacal solution to further improve their physical characteristics. The resulting aged and gelled particles are then washed and dried at a relatively low temperature of about 300° F. to about 400° F. and subjected to a calcination procedure at a temperature of about 850° F. to about 1300° F. for a period of about 1 to 20 hours. This treatment effects conversion of the alunina hydrogel to the corresponding crystalline gamma alumina. See U.S. Pat. No. 2,620,314 for additional details regarding this oil drop method. Further details of the preparation of a suitable carrier material can also be found in U.S. Pat. No. 3,677,973.

A preferred hydrocracking catalytic composite of the present invention comprises mordenite containing alumina fixed in combination therewith, as hereinabove described, and a palladium component. The mordenite may be present in quantities ranging from about 60 percent to about 90 percent by weight of the carrier material. The palladium component may exist within the final composite as a compound such as an oxide, sulfide and halide, or in an elemental state. In a preferred embodiment, the palladium component exists in the catalytic composite as a sulfide. In order to pressure the metals in the sulfided state during the processing operation, the charge stock may contain from about 5 to about 5000 ppm by weight of sulfur. When calculated on an elemental basis, the palladium component generally comprises from about 0.01 to about 5 percent by weight of the final composite.

The platinum group metals may be incorporated with the zeolitic composite used for the hydrocracking function in any suitable manner including co-precipitation or co-gellation with the carrier material, ion-exchange or impregnation. The latter constitutes the preferred method of preparation, utilizing water soluble compounds of the metallic components. Thus, for example, a palladium component may be added to the carrier material by commingling the latter with an aqueous solution of chloropalladic acid, palladic chloride or other water-soluble compounds of palladium. Following impregnation, the carrier material is dried and subjected to a calcination, or oxidation technique, generally followed by reduction with hydrogen at an elevated temperature. Prior to its use, the catalytic composite may be subjected to a substantially water-free reduction technique. This is designed to insure a more uniform and finely divided dispersion of the metallic components throughout the carrier material. Substantially pure and dry hydrogen is employed as the reducing agent at a temperature of about 800° F. to about 1200° F., and for a time sufficient to reduce the metallic component.

The resulting reduced catalyst is preferably subjected to a presulfiding operation designed to incorporate in the catalytic composite from about 0.05 to about 2 weight percent sulfur calculated on an elemental basis. Preferably, this presulfiding treatment takes place in the presence of hydrogen and a suitable sulfur-containing compound such as hydrogen sulfide, lower molecular weight mercaptans, organic sulfides, etc. Typically, this procedure comprises treating the reduced catalyst with a sulfiding gas such as a mixture of hydrogen and hydrogen sulfide having about 10 mols of hydrogen per mol of hydrogen sulfide at conditions sufficient to effect the desired incorporation of the sulfur component, generally including a temperature ranging from about 50° to about 1100° F. or more.

Since the preferred use of the present invention is the integration thereof into an overall refinery scheme with the production of a high octane, unleaded motor fuel gasoline pool, the resulting iso butane may be utilized as fresh feed to an alkylation reaction zone. The alkylation is effected by intimately commingling the isobutane feed, an olefinic hydrocarbon and a particular catalyst such as hydrofluoric acid. It is understood that the source of the olefinic hydrocarbon, for utilization in the alkylation reaction zone, is not essential to the process encompassed by the present invention.

The invention concept, encompassed the present process, and a preferred embodiment, are illustrated in the following example. It is understood that the example is intended to be merely illustrative rather than restrictive.

A heptane-plus straightrun naphtha which has been subjected to hydrorefining for desulfurization and olefin saturation is selected and has properties which include a gravity of 56.4° API, an initial boiling point of about 194° F., a 50% volumetric distillation temperature of about 255° F. and an end boiling point of about 362° F. This naphtha contains approximately 44.4 volume percent paraffin, 48.8 volume percent naphthenes and 6.8 volume percent aromatics.

The fresh feed hereinabove described is processed in a catalytic reaction which contains a volume ratio of 5 of the reforming catalyst to hydrocracking catalyst. The reforming catalyst is an alumina carrier material containing 0.3 weight percent platinum, 0.2 weight percent tin, 1.0 weight percent cobalt and 1.0 weight percent of combined chloride, all of which are computed on the basis of the elements. The hydrocracking catalyst is a composite of mordenite and 3 weight percent palladium. Processing conditions include a liquid hourly space velocity of 3, a hydrogen to hydrocarbon mole ratio of 4, an average catalyst bed temperature of 507° C., and a pressure of 300 psig.

The effluent stream is separated into a combined methane and ethane fraction which fraction comprises 9.2 weight percent of the original feedstock and a propane-plus stream. A component yield and product distribution of the propane-plus stream are presented in the following Table I.

TABLE I

| Component | Volume Percent |
|---|---|
| Propane | 9.21 |
| Isobutane | 24.02 |
| n-butane | 3.60 |
| Isopentane thru n-hexane | 9.92 |
| Aromatic gasoline | 53.25 |
| | 100.0 |

As indicated in the foregoing Table I, a considerable quantity of isobutane and high octane aromatic gasoline is produced.

The foregoing demonstrates the method by which the present invention is effected and the benefits afforded through the utilization thereof.

I claim as my invention:

1. A process for the simultaneous production of a high octane motor fuel and isobutane which comprises the steps of:

(a) contacting a hydrocarbon boiling at a temperature of less than about 450° F. and containing cyclic components including aromatics with hydrogen in a reaction zone, containing a commingled physical mixture of a first catalytic composite comprising palladium component and a zeolitic aluminosilicate carrier material and a second catalytic composite comprising alumina, platinum and a platinum promotor selected from the group of rhenium, tin, germanium, cobalt, nickel, iridium, rhodium and ruthenium or combinations of these promoters, at a temperature in the range of about 700° F. to about 1100° F. and at a pressure of from about 100 to about 700 psig.; and (b) recovering a high octane motor fuel and isobutane from the resulting reaction zone effluent.

2. The process of claim 1 wherein the volume ratio of said catalytic composite to said second catalytic composite is from about 1:10 to about 10:1.

3. The process of claim 1 wherein said carrier material is mordenite containing alumina fixed in combination therewith.

* * * * *